United States Patent [19]

Peck et al.

[11] 4,146,762

[45] Mar. 27, 1979

[54] CLOSURE SWITCH

[75] Inventors: Vincent W. Peck, Waltham; Harold S. van Buren, Jr., Lexington; Norman K. Parker, Franklin, all of Mass.

[73] Assignee: TRW Inc., Cleveland, Ohio

[21] Appl. No.: 822,462

[22] Filed: Aug. 8, 1977

[51] Int. Cl.[2] ..... H01H 3/16

[52] U.S. Cl. ..... 200/61.62; 200/61.7; 362/61

[58] Field of Search ..... 16/179, DIG. 13; 200/61.58 B, 61.62, 61.64, 61.67, 61.68, 61.7, 61.81, 61.82, 159 R, 295, 296, 339; 362/61, 75, 80, 295, 306, 362, 365, 94, 155, 802; 361/61, 75, 295, 802

[56] References Cited

U.S. PATENT DOCUMENTS

| | | | |
|---|---|---|---|
| 2,686,852 | 8/1954 | Brown | 200/159 R X |
| 2,788,407 | 4/1957 | Brown | 200/61.82 |
| 2,816,972 | 12/1957 | Haut | 200/61.62 |
| 2,907,852 | 10/1959 | Long et al. | 200/159 R |
| 3,048,674 | 8/1962 | Hopkins | 200/61.7 |
| 3,393,281 | 7/1968 | Basso | 200/61.62 |
| 3,692,992 | 9/1972 | Bain et al. | 200/61.62 X |

*Primary Examiner*—James R. Scott

*Attorney, Agent, or Firm*—James R. O'Connor; Martin J. O'Donnell; Thomas C. O'Konski

[57] ABSTRACT

A closure switch operates a bulb that illuminates a compartment in response to the opening and closing, respectively, of the compartment's closure lid. A metal bracket carries the switch and a striker member for a latch carried by the closure lid. The bracket also serves as a current carrying member of the switch and includes a terminal for connection into an electrical circuit, e.g., to ground. A molded plastic housing mounts to the bracket and retains the bulb. The housing includes an integral or "living" hinge that is pivoted from a first to a second position by the latch when the lid is closed. When the lid is open and the hinge member is in its first position, the circuit through the bulb is complete. When the lid is closed, the latch on the lid pivots the hinge to its second position and the circuit is broken.

16 Claims, 6 Drawing Figures

CLOSURE SWITCH

BACKGROUND OF THE INVENTION

1. Field of the Invention

This invention relates generally to switches and, more particularly, to a switch that is adapted for use with a compartment having an access opening closable by a closure member and that is activated in response to the opening and closing of the compartment by the closure member. The switch is particularly adapted for use with storage compartments of the type found in automotive vehicles to control the energization of a lamp bulb used to illuminate the compartment.

2. Description of the Prior Art

Closure activated switches are presently used in a variety of fields including, for example, automotive vehicles, domestic appliances and alarm and anti-theft systems. In a typical prior construction, the switch includes a pushbutton or plunger that is biased by a spring into a protruding position and that is disposed so as to be depressed against the action of the spring upon the closing of the closure member. The plunger operatively engages other components within the switch so that, when the plunger is depressed, an electrical circuit through the switch is either made or broken. Examples of prior closure activated switches are shown in the following U.S. Pat. Nos. 2,615,083; 3,048,674; 3,157,756; 3,193,673; 3,393,281; 3,432,634; 3,440,373; and 3,609,265.

For most applications, and particularly for automotive applications, it is important that the closure activated switches be relatively economical to manufacture and install and, at the same time, durable in use. As can be appreciated from a review of the above patents, a major drawback of many prior switches is their relative complexity and relatively large number of operating parts. This complexity not only adds to the cost of manufacturing the switches, but also oftentimes increases the likelihood of their premature failure because of the number of parts that are susceptible to failure.

Another, more specific problem is often encountered with prior switches, particularly those of the type including a plunger that is depressed by a closure member. Generally, in such switches, the plunger must be depressed to a predetermined point before the switch is activated. Because of the nature of manufacturing conditions, particularly those in the automotive industry, the clearances between a closed closure member and a frame member associated therewith in which the switch is typically mounted are difficult to control. These clearances also in many cases vary during the life of a vehicle as a result of the numerous openings and closings of the closure member. If these clearances are, or become, too large, the switch is not activated when the closure member closes and the usefulness of the switch is defeated.

OBJECTS OF THE INVENTION

A primary object of the present invention is to provide an improved closure switch.

Another object of the invention is to provide an improved closure switch that includes relatively few operational parts, each of which is simplified, relatively inexpensive to manufacture and easy to assemble.

Another object of the invention is to provide a closure switch of the type described that includes a multipurpose member that serves as a bracket for mounting the switch relative to a closure member, as a current carrying member of the switch and as part of a latching mechanism for latching the closure member in a closed position, thus eliminating the need for separate such components.

Another object of the invention is to provide a closure switch of the type described that is adapted to retain a lamp bulb and to energize and de-energize the lamp bulb in response to the opening and closing, respectively, of the closure member.

Another object of the invention is to provide a closure switch of the type described that is activated by a latch carried by the closure member so as to insure that when the closure member is latched closed, the switch is properly activated.

Still another object of the invention is to provide a closure activated switch of the type described that is particularly adapted for use in conjunction with a storage compartment within an automotive vehicle.

SUMMARY OF THE INVENTION

Briefly, a closure switch fabricated in accordance with the invention includes a bracket that carries the remaining components of the switch and that mounts within a compartment closable by a closure lid. The bracket serves as a current carrying member of the switch and thus includes a projection that serves as one terminal of the switch for connection into an electrical circuit. The bracket also includes a forwardly projecting latch striker member that is engaged by a latch carried by the closure lid for retaining the lid in a closed position over the compartment.

A switch housing mounts to the bracket and includes a lamp bulb receiving portion in which a lamp bulb for illuminating the compartment is retained. An integral or "living" hinge member projects from the housing and is disposed so as to be engaged by the lid latch and pivoted from a first to a second position in response to the closing of the lid.

A first contact member is mounted to the housing and includes a first end that serves as the other terminal of the switch for connection into the electrical circuit and a second end that extends into the housing so as to contact the bulb. A second contact member is mounted to the housing but in such a manner as to be electrically isolated from the first contact member. One end of the second contact member contacts the bulb in the housing while the other end is carried by the integral hinge member and contacts the bracket when the hinge member is in its first position. Thus, when the closure lid is open and the hinge member is in its first position, the electrical circuit through the first contact member, the bulb, the second contact member, and the bracket is complete and the bulb is energized to illuminate the compartment.

When the closure lid is closed, however, the lid latch bears against the hinge member and pivots it to its second position. The hinge member, in turn, moves the second contact member away from the bracket to open or break the electrical circuit through the bulb. The bulb is thus automatically de-energized when the lid is closed.

In a preferred embodiment of the invention, the bracket is fabricated as an integral unit from a current conducting material such as steel. Because of the multiple functions of the one-piece bracket, there is no need to provide a separate mounting bracket for the switch, one of the switch terminals and a separate latch striker member for the lid latch. The housing is preferably fabricated as a one-piece molded plastic part. The integral hinge member eliminates the need for a separate pushbutton or plunger of the type found in prior switches. Additionally, the first and second contact members are preferably fabricated from a spring metal material. The resiliency of the contact members is used to advantage to insure a firm retention of the bulb in the housing, to insure good electrical contact to the bulb and to bias the hinge member to its first position to insure that the bulb is always energized when the closure lid is open. Thus, separate spring members need not be included in the switch to serve these purposes.

BRIEF DESCRIPTION OF THE DRAWING

The foregoing and other objects, features and advantages of the invention will be better understood from the following detailed description taken in conjunction with the accompanying drawing in which.

DETAILED DESCRIPTION OF PREFERRED EMBODIMENT

Figure 1:
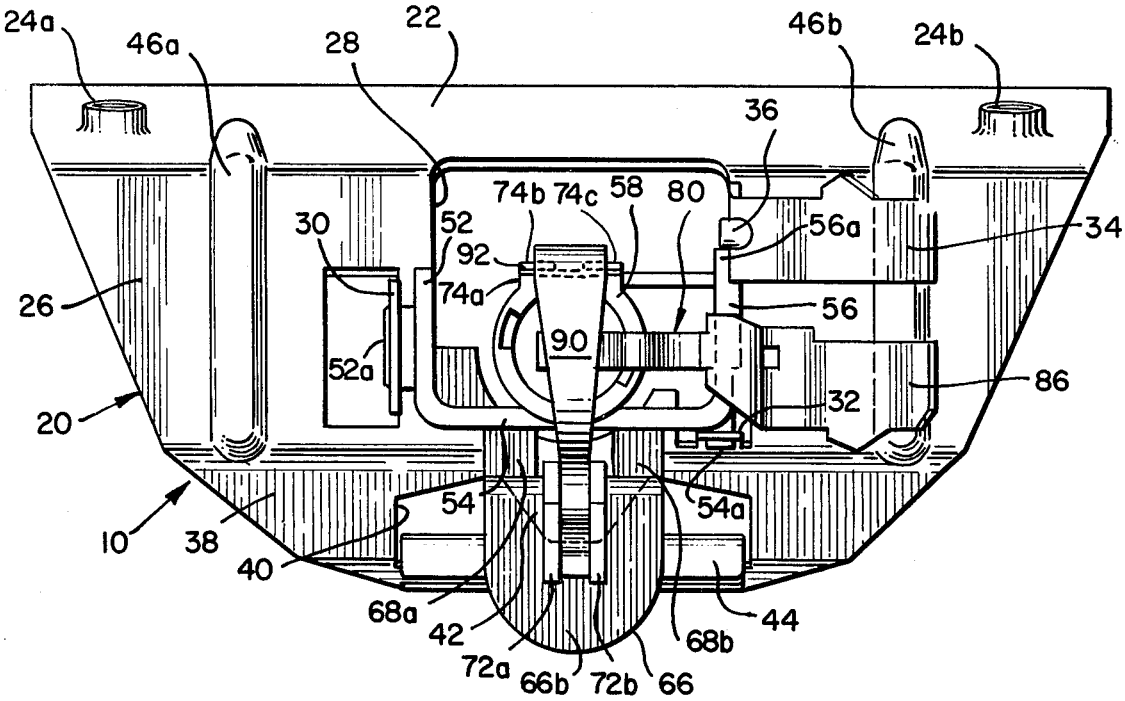
FIG. 1 is a rear plan view of a closure switch embodying the invention.

Referring now to the drawing, and particularly to FIGS. 1–4 thereof, there is shown a closure switch embodying the invention and indicated generally by the reference numeral 10. The switch 10 comprises a bracket 20, a housing 50, a first contact member 80 and a second contact member 90. The contact members 80 and 90 are mounted to the housing 50 and the housing 50 is, in turn, mounted to the bracket 20. The housing 50 is adapted to retain a lamp bulb 100, which is shown in phantom in FIGS. 2 and 3, and which is energized and de-energized by activation of the switch 10.

Figure 5:
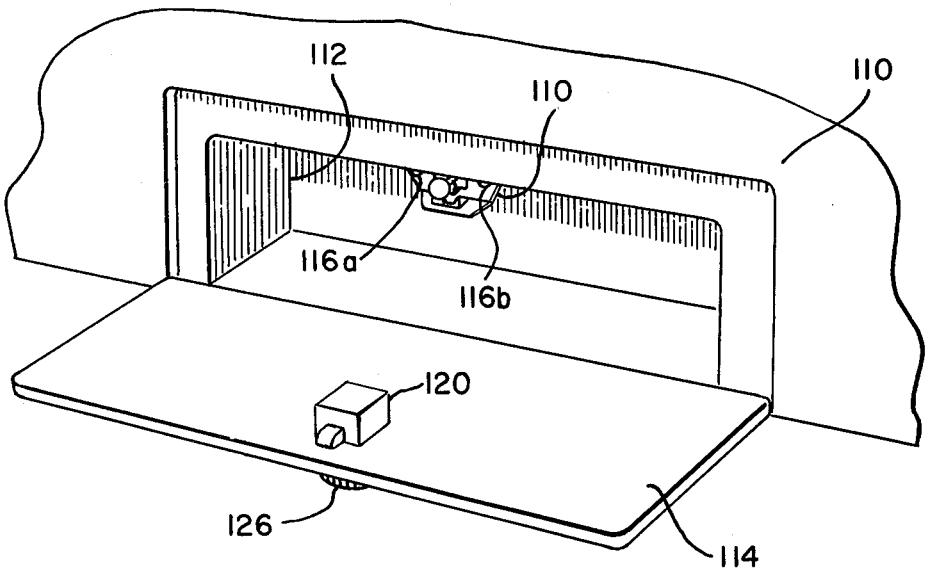
FIG. 5 illustrates a vehicle dashboard glove box compartment in which the switch of FIG. 1 is shown installed.

More specifically, the bracket 20, which is preferably fabricated from a rigid, current carrying material such as steel, includes a forwardly projecting, plate-like portion 22. A pair of spaced-apart holes **24*a* and 24*b* are extruded through the portion 22. The portion 22 is adapted for mounting the bracket 20 and other components of the switch 10 carried thereby near the access opening of a compartment closable by a closure lid. As an example of a typical application of the switch 10, a portion of a vehicle dashboard 110 is shown in FIG. 5 of the drawing including a glove box compartment 112 having an access opening that is opened and closed by a closure lid 114 hinged to the dashboard along its bottom edge. The switch 10 is shown mounted within the compartment 112 in FIG. 5. The mounting is accomplished by securing the mounting portion 22 of the bracket 20 to an upper frame member in the compartment 112 using a pair of screws 116*a* and 116*b* that pass through the holes 24*a* and 24*b*. The switch 10 is mounted sufficiently close to the forward end of the compartment 112 so that it is operatively engaged by a latch 120 carried by the lid 114** when the lid is closed in a manner more fully described below.

Referring now to FIGS. 1–4, it can further be seen that the bracket 20 includes a center portion 26 that is downwardly bent at an angle to the plane of the mounting portion 22. An opening 28 is stamped through the center portion 26 through which the housing 50 is exposed and the bulb 100 protrudes. A pair of tabs 30 and 32 (FIG. 1) are stamped from the center portion 26 so as to project toward the rear of the bracket 20. Apertures **30*a* (FIG. 2) and 32*a* (FIG. 4) are stamped through the base of the tabs 30 and 32, respectively. As explained below, the apertures 30*a* and 32*a* are used in securing the housing 50 to the bracket 20**.

As noted, the bracket 20 serves as a current carrying member of the switch 10 for connection into an electrical circuit which, in the illustrative application, is typically a circuit extending from the vehicle battery to electrical connection to the bracket 20. For this reason, the bracket 20 includes a terminal 34 (FIG. 1) which is stamped from the center portion 26 and that projects from the rear of the bracket. The free end of the terminal 34 is shaped to enable connection thereto by a suitable electrical connector. The terminal 34, and thus the bracket 20, are typically connected to electrical ground.

During the stamping of the terminal 34 from the bracket 20, a boss 36 is preferably provided on the terminal 34 that serves to strengthen the terminal against bending. An aperture **34*a* (FIG. 4) is also provided at the base of the terminal 34 which, like the apertures 30*a* and 32*a*, is used in securing the housing 50 to the bracket 20**.

The bracket 20 further includes a lower portion 38 that is bent forwardly at an angle to the center portion 26 thereof. An opening 40 is stamped through the center of this portion 38. Material at the upper end of the opening 40 is bent downwardly relative to the plane of the portion 38 to form a contact tab 42. Material at the lower end of the opening 40 is bent together with the free end of the portion 38 to form a closed, generally cylindrical member 44. As explained more fully below, the member 44 serves as a latch striker member which is engaged by the latch 120 on the closure lid 114 to retain the closure lid 114 in a closed position over the compartment 112.

During the fabrication of the bracket 20, a pair of bosses **46*a* and 46*b* are preferably provided on opposite sides of the opening 28 to strengthen the bracket 20** against bending.

The housing 50 is also preferably fabricated as an integral unit but from a plastic material such as nylon. The housing 50 includes three interconnected side members 52, 54 and 56 that bear against the rear surface of the center portion 26 of the bracket 20 and extend about the lower periphery of the opening 28 therein. Tabs **52*a*, 54*a* and 56*a* (FIG. 1) project outwardly from the base of the side members 52, 54 and 56, respectively. These tabs are positioned so as to engage within the apertures 30*a*, 32*a* and 34*a* in the tabs 30 and 32 and the terminal 34, respectively, and to hold the housing 50 on the bracket 20**.

A bulb receiving portion 58 is formed as a part of the side member 54. The bulb receiving portion 58 is generally cylindrical in shape and includes an opening 60 (FIG. 4) that is directed toward the front of the bracket 20 through the opening 28 in the center portion 26 thereof. The opening 60 is dimensioned and designed to receive and retain the base 102 of the bulb 100. The bulb 100 may, for example, be a standard automotive bulb, the base 102 of which includes a pair of radially projecting buttons 104 and 106 (FIG. 3) that enable the bulb to be pushed into the opening 60 and to be given a slight twist to retain it there. The bulb receiving portion 58 of the housing 50 may thus include a pair of opposed inside grooves 62*a* and 62*b* (FIG. 4) in which the bulb buttons 104 and 106 are guided as the bulb is pushed into the opening 60. A pair of opposed openings 64*a* and 64*b* (FIG. 3) are located at the inner ends of the grooves 62*a* and 62*b* and receive the buttons 104 and 106 when the bulb 100 is twisted. The openings 64*a* and 64*b* are laterally offset relative to the grooves 62*a* and 62*b* to prevent the bulb 100 from being withdrawn from the opening 60 without first twisting it in the opposite direction. Bulb stop 65 limits the extent to which the bulb may be inserted in the socket and is so located that, when it is engaged, the buttons 104 and 106 are properly positioned for entering openings 64*a* and 64*b* as the bulb is twisted.

An integral or "living" hinge member 66 projects from the surface of the side member 54 opposite to the bulb receiving portion 58. The hinge member 66 normally extends from the side member 54 at a slight forward angle so that the front face 66*a* of the hinge member 66 contacts the free end of the bracket contact tab 42. The hinge member 66 connects to the side member 54 by a pair of connecting webs 68*a* and 68*b*. The connecting webs 68*a* and 68*b* are thinned down somewhat relative to the remainder of the hinge member 66 so that they flex to enable the hinge member 66 to be pivoted relative to the side member 54 and away from the tab 42. An aperture 70 extends through the center of the hinge member 66, i.e., at the point where the front face 66*a* thereof contacts the free end of the tab 42. A pair of triangular abutments 72*a* and 72*b* are formed on the rear face 66*b* of the hinge member 66 on opposite sides of the aperture 70. The abutments 72*a* and 72*b* contact the side member 54 when the hinge member 66 is pivoted through a certain angle away from the tab 42 and thereby prevent overstressing of the connecting webs 68*a* and 68*b*.

Figure 3:
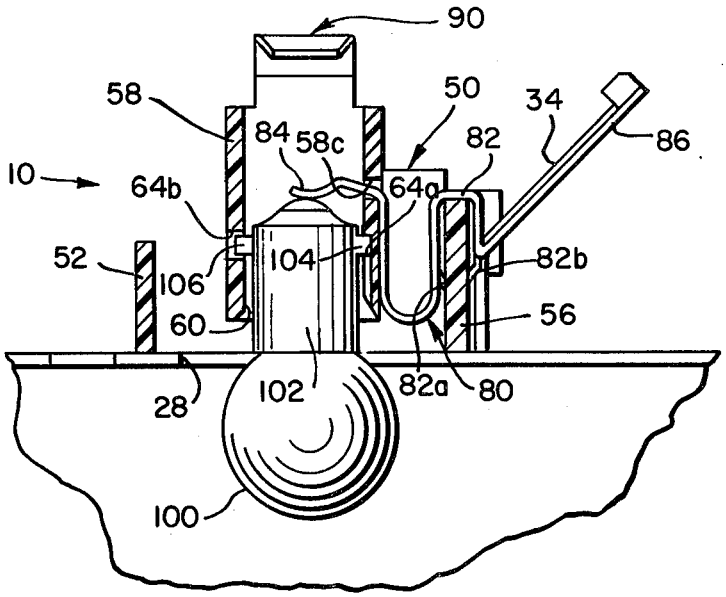
FIG. 3 is a bottom view in section of the switch of FIG. 1.
Figure 4:
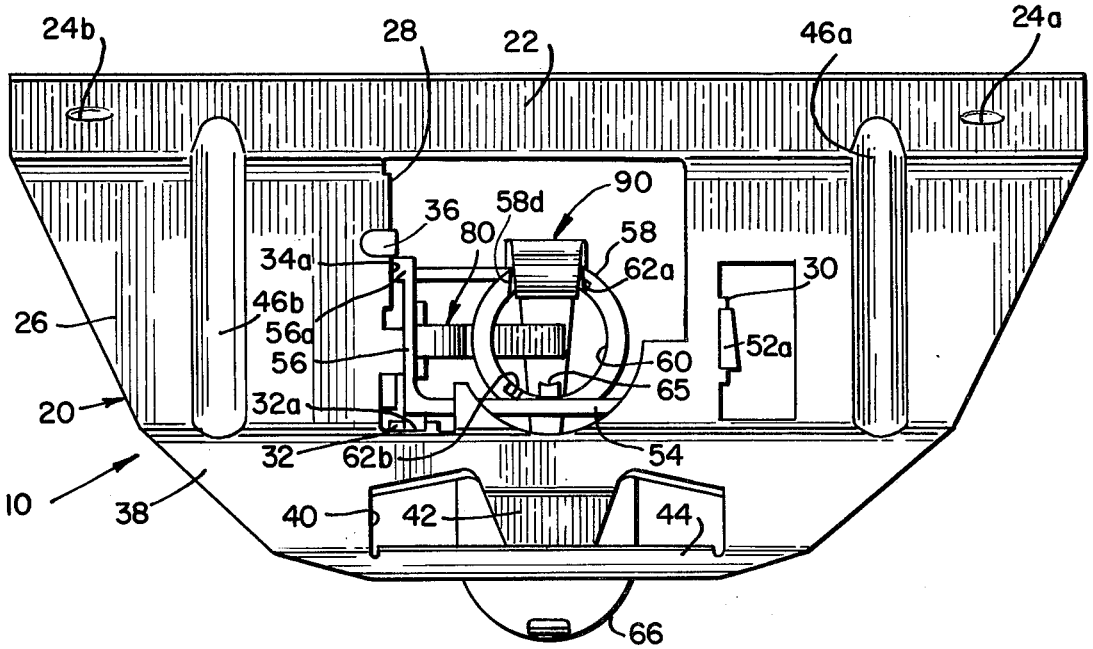
FIG. 4 is a front plan view of the switch of FIG. 1.

The first spring contact member 80 mounts to the side member 56 of the housing 50. As best seen in FIG. 3, the contact member 80 includes an intermediate portion 82 that is bent into the shape of an inverted "U" and that fits over the side member 56. A pair of inwardly turned teeth 82*a* and 82*b* are formed in the portion 82 which can be crimped against opposite sides of the side member 56 to retain the contact member 80 in position. The left end portion of the contact member 80, as viewed in FIG. 3, extends upwardly along the outside surface of the bulb receiving portion 58 and then into the portion 58 through an opening 58*c* where it forms a contact 84 to the tip of the bulb base 102. The contact portion 84 of the contact member 80 is downwardly bent so that it serves as a spring in biasing the bulb 100 out of the opening 60. This biasing action insures that the bulb 100 is firmly retained in the housing 50 and also insures that continuous contact is maintained between the contact portion 84 and the tip of the bulb base 102.

The opposite or right end portion 86 of the contact member 80, as viewed in FIG. 3, projects from the side member 56 at an angle that makes it essentially parallel to the terminal 34 projecting from the bracket 20. The portion 86 serves as the second terminal of the switch 10 for connection into the electrical circuit, typically, to a wire from the positive side of the vehicle battery. As best seen in FIG. 1 of the drawing, the terminal portion 86 of the contact member 80 is shaped to enable connection thereto by a suitable wire connector.

It will be noted from FIG. 1 that the terminals 34 and 86 in the switch 10 have slightly different configurations. These configurations are selected for use with wire connectors designed to prevent the improper connection of the switch 10 into the electrical circuit. For example, a ground connector is typically used which easily fits on the terminal 34 but which is rejected if an attempt is made to push it onto the terminal 86. Similarly, a positive connector is typically used which easily fits on the terminal 86 but which is rejected if an attempt is made to push it onto the terminal 34. Connectors of this type are conventionally used in the automotive industry.

Figure 2:
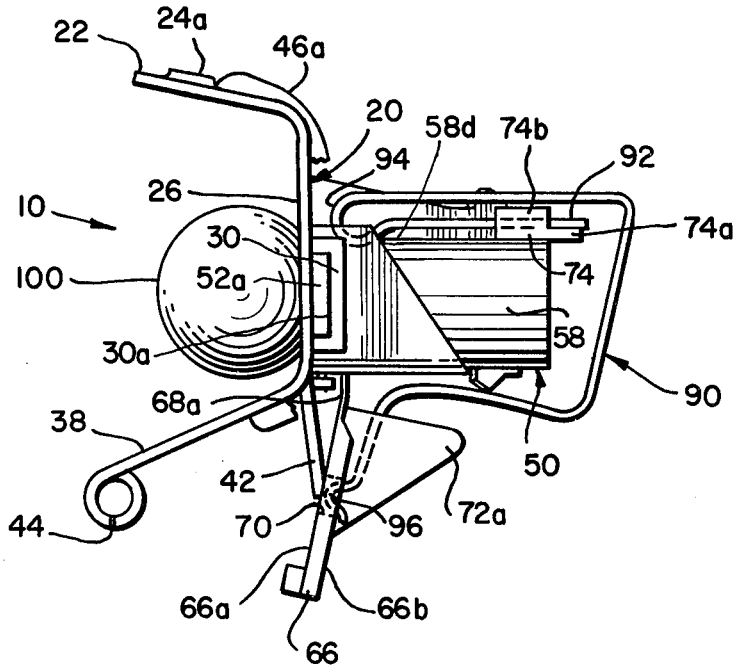
FIG. 2 is a side view of the switch of FIG. 1.

The second spring contact member 90 mounts to the bulb receiving portion 58 of the housing in such a manner as to be electrically isolated from the contact member 80. A first end 92 of the contact member 90 is retained within a retaining portion 74 formed at the upper rear end of the bulb receiving portion 58. As best seen in FIGS. 1 and 2, the retaining portion 74 comprises a raised ridge 74*a* and pair of finger members 74*b* and 74*c* that extend up from opposite sides of the ridge 74*a* and then toward each other so as to overlap the ridge. The end 92 of the contact member 90 has the shape of a "T", the shank portion of which fits on the ridge 74*a* beneath the overlapping portions of the finger members 74*b* and 74*c* and the cross member of which bears against the rear ends of the finger members 74*b* and 74*c*.

The contact member 90 extends forwardly from the end portion 92 along the outside surface of the bulb receiving portion 58 of the housing 50 to a point where an enlarged diameter bend 94 is formed. The bend 94 extends through an opening 58*d* (FIG. 4) in the bulb receiving portion 58 and into contact with the side or shell of the bulb base 102. The contact member 90 then extends rearwardly completely around the bulb receiving portion 58 and into contact with the rear face 66*b* of the hinge member 66. At this latter point, a U-shaped bend 96 is formed in the contact member 90 which extends through the aperture 70 in the hinge member 66 into contact with the bracket contact tab 42. The bends in the contact member 90 are such that the bend 94 is normally biased into contact with the shell of the bulb base 102 and the bend 96 is normally biased into contact with the tab 42 thus forcing the hinge member 66 to assume the position illustrated in FIG. 2.

To provide the desired resiliency to the contact members 80 and 90, both are preferably fabricated as integral units from an electrically conductive spring metal material.

When the hinge member 66 as in the position illustrated in FIG. 2, the bend 96 in the contact member 90 is in electrical contact with the tab 42 of the bracket 20. As a result, the electrical circuit through the contact member 80, the bulb 100, the contact member 90, and the bracket 20 is complete and the bulb 100 is energized. The bulb 100 is de-energized by pivoting the hinge member 66 into the position illustrated in FIG. 6 of the drawing. This breaks the contact between the bend 96 in the contact member 90 and the tab 42 of the bracket 20 and consequently opens the electrical circuit and de-energizes the bulb 100. When the hinge member 66 is released, the contact member 90 biases the hinge member 66 back into the position illustrated in FIG. 2. The bend 96 in the contact member 90 again contacts the tab 42 and the bulb 100 is again energized.

Figure 6:
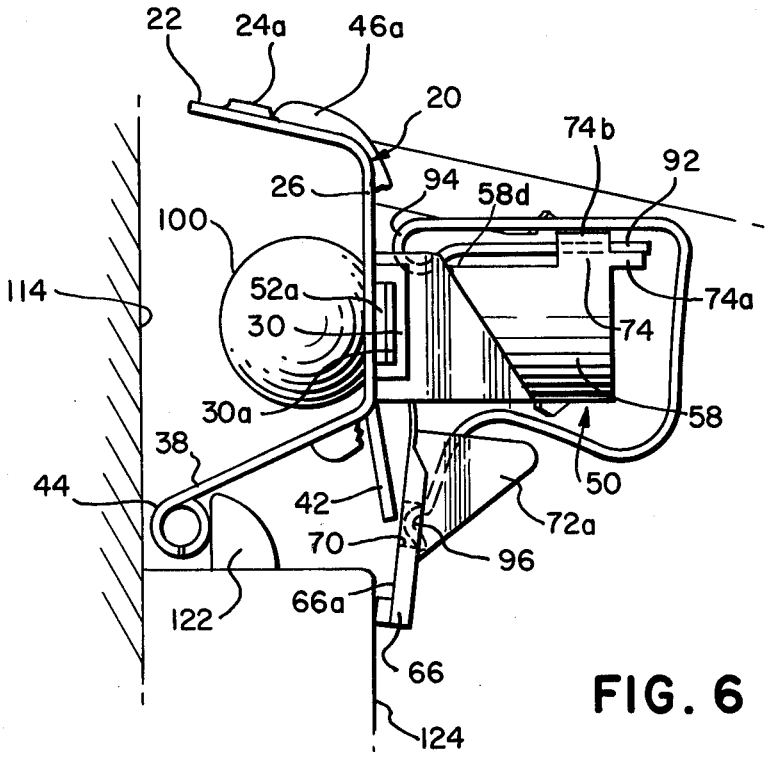
FIG. 6 is a side view similar to FIG. 2 but showing the condition of the switch when contacted by a latch on a closure lid.

FIG. 6 illustrates further details of the latch 120 shown in FIG. 5 and also illustrates the manner in which the latch 120 engages the latch striker member 44 on the bracket 20 and activates the switch 10 when the lid 114 is closed over the compartment 112. The latch 120 may, for example, be of a conventional construction that includes a latching bolt 122 that is retained within a latch casing 124 secured to the inside surface of the lid 114. A spring (not shown) inside the casing 124 biases the bolt 122 into a protruding position. The protruding end of the bolt 122 is typically cut at an angle, as indicated in FIG. 6, so that when the lid 114 is pushed closed, the bolt 122 engages against the latch striker member 44 and is forced downwardly against the action of the latch spring. When the lid 114 is fully closed and the bolt 122 clears the latch striker member, the bolt 122 snaps back to its protruding position to retain the lid 114 in a fully closed position. Typically, a latch releasing mechanism 126 (FIG. 5) is secured to the outside surface of the lid 114 to retract the latch bolt 122 when the lid 114 is to be opened.

It can be seen from FIG. 6 that when the lid 114 is latched closed, the latch casing 124 engages against and pivots the hinge member 66 away from the contact tab 42 on the bracket 20. Thus, as long as the clearance between the lid 114 and the dashboard 110 is sufficient for the latch 120 to operate, the switch 10 will also be operated to de-energize the lamp bulb 100.

As should now be appreciated, the switch 10 has numerous attractive features. Each of the component parts of the switch 10 serves more than one useful function. The bracket 20, for example, serves as a mounting bracket for the switch, as a latch striker member, and as one current carrying member of the switch, thus eliminating the need for separate such components. The integral hinge member 66 on the housing 50 eliminates the need for a separate pushbutton or plunger of the type found in most prior switches. Additionally, because of the resiliency of the contact members 80 and 90, they eliminate the need for separate springs for firmly retaining the bulb 100 in the housing 50 and for biasing the hinge member 66 to a position to energize the bulb 100 when the lid 114 is opened.

The contact member 90 is such that when the hinge member 66 is pivoted to the position illustrated in FIG. 6, it does not loosen the bulb 100 but instead presses against the bulb base 102 more firmly. Also, the tension in the contact member 90 when the hinge member 66 is pivoted to the position of FIG. 6 is taken up almost completely in the bend 94 rather than in the end portion 92. This prevents loosening of the contact member 90 relative to the housing 50 during the life of the switch 10.

Each of the component parts of the switch 10 are also particularly economical to manufacture. The bracket 20, for example, can be stamped from a single piece of steel stock material. The housing can be molded from plastic using an essentially one-step molding process, such as injection molding. The spring contact members 80 and 90 can be stamped from a suitable spring metal stock, such as 12 mil spring steel, and mechanically bent to shape prior to assembly with the housing 50.

Tests performed on the switch 10 indicate that it meets and exceeds automotive manufacturers' specifications for reliability and durability in use.

It should be understood that the above-described embodiment is intended to illustrate rather than limit the invention and that various modifications may be made thereto by those skilled in the art without departing from the scope of the invention as defined by the appended claims.

For example, it is not essential that the housing 50 be adapted to retain the lamp bulb 100. Rather, it is clearly possible to design the contact members 80 and 90 so that they are in electrical contact with each other, either by being in direct physical contact or in mutual contact with a conductive plug or other such element, for example, a terminal or the like which is electrically connected to the wires of a so-called capless or wedge-base bulb, within the housing when the hinge member 66 is in the position shown in FIG. 2, and so that the contact member 90 is moved to break electrical contact with the bracket 20 when the hinge member 66 is moved to the position shown in FIG. 6. The switch 10 in such a modified form could thus be connected into an electrical circuit to control a component, such as the lamp bulb 100, that is mounted in a location remote from the switch. The switch 10 may also be used with closure members other than the vehicle glove box closure lid 114 mentioned above. It is thus the object of the appended claims to cover these and other modifications as come within the true spirit and scope of the invention.

What we claim as new and desire to secure by Letters Patent of the United States is:

1. A switch for mounting relative to a compartment having an access opening closable by a closure lid, the closure lid carrying means for latching the closure lid in a closed position, said switch being activated to energize and de-energize a lamp bulb for illuminating the compartment in response to the opening and closing, respectively, of the closure lid, said switch comprising:

A. a bracket for mounting relative to the compartment and for connection into an electrical circuit;

B. a housing mounted to said bracket, said housing being formed from an insulating material and including i. a lamp bulb receiving portion for receiving and retaining the lamp bulb, and ii. a movable member disposed on said housing so as to be engaged by the latching means on the closure lid and moved from a first position to a second position in response to the closing of the closure lid;

C. a first contact member mounted to said housing and including i. a first portion for connection into the electrical circuit, and ii. a second portion for connecting to the bulb; and D. a second contact member mounted to said housing and including i. a first portion for connecting to the bulb, and ii. a second portion carried by said movable housing member for contacting said bracket when said movable housing member is in its first position thereby to complete the electrical circuit through the bulb and energize the bulb, said second portion of said second contact member being movable away from said bracket when said movable housing member is moved to its second position thereby to open the electrical circuit and de-energize the bulb.

2. The switch of claim 1 in which said bracket comprises i. a mounting portion for mounting said bracket relative to the compartment, ii. a terminal portion for connection into the electrical circuit, and iii. a latch striker portion engageable by the lid latching means when the closure lid is moved to its closed position for retaining the closure lid in its closed position.

3. The switch of claim 2 in which said bracket is formed as an integral unit from a rigid metal.

4. The switch of claim 1 in which said first and second contact members are each formed as an integral unit from a spring metal material.

5. The switch of claim 1 in which the bulb is of the type including a base having a tip and a shell that are connectable into the electrical circuit to energize the bulb and in which the second portion of said first contact member is disposed within said housing to resiliently contact the tip of the bulb base.

6. The switch of claim 1 in which the first position of said first contact member is formed as a terminal for connection to a voltage source in the electrical circuit.

7. The switch of claim 1 in which the bulb is of the type including a base having a tip and shell that are connectable into the electrical circuit to energize the bulb and in which the first portion of said second contact member is disposed for resiliently contacting the shell of the bulb base.

8. The switch of claim 2 in which the terminal portion of said bracket is formed as a terminal for connection to electrical ground.

9. The switch of claim 1 in which the second portion of said second contact member biases said movable housing member into its first position.

10. The switch of claim 1 in which said movable housing member comprises a hinge member formed as an integral part of said housing and pivotal from a first to a second position in response to the closing of the closure lid.

11. The switch of claim 10 in which said hinge member includes first and second opposed surfaces that define an aperture extending through said hinge member, in which the second portion of said second contact member engages the first surface of said hinge member and is bent into the aperture so as to be exposed at the second surface of said hinge member, and in which said bracket includes an integral contact tab that projects toward the second surface of said hinge member and that contacts the bend in the second portion of said second contact member when said hinge member is in its first position.

12. The switch of claim 10 in which said hinge member connects to said housing by a connecting end portion that is thinned down relative to the remainder of said hinge meber to facilitate the pivotal motion of said hinge member relative to said housing.

13. The switch of claim 10 in which said hinge member includes abutment means projecting therefrom for engaging against said housing when said hinge member is pivoted from its first position to its second position thereby to limit the extent of motion of said hinge member.

14. The switch of claim 10 in which said housing is formed as in integral unit from a plastic material.

15. The switch of claim 14 in which said housing is formed from nylon.

16. A switch for mounting relative to a compartment having an access opening closable by a closure member carrying latching means, said switch including a latching means engager for latching the closure member in a closed position, said switch being activated between a circuit-making condition and a circuit-breaking condition in response to the opening and closing of the closure member, said switch comprising A. a metallic bracket for mounting relative to the compartment and for connection into an electrical circuit;

B. a housing mounted to said bracket, said housing being formed from an insulating material and including i. a movable member disposed on said housing so as to be engageable by the latching means and moved from a first position to a second position in response to the closing of the closure member;

C. a first contact member mounted to said housing and including i. a portion for connection into the electrical circuit;

D. a second contact member mounted to said housing and including i. a portion carried by said movable housing member for contacting said bracket when said movable housing member is in its first position;

E. said first and second contact members being relatively disposed so as to complete the electrical circuit through said switch when said movable housing member is in its first position; and F. the bracket contacting portion of said second contact member being movable away from said bracket when said movable housing member is moved by the latching means to its second position thereby to break the electrical circuit through said switch.

* * * * *